US011739485B2

(12) United States Patent
Noland

(10) Patent No.: US 11,739,485 B2
(45) Date of Patent: Aug. 29, 2023

(54) ICE ELIMINATION DEVICE

(71) Applicant: Mark Noland, Big Fork, MT (US)

(72) Inventor: Mark Noland, Big Fork, MT (US)

( * ) Notice: Subject to any disclaimer, the term of this patent is extended or adjusted under 35 U.S.C. 154(b) by 0 days.

(21) Appl. No.: 16/878,704

(22) Filed: May 20, 2020

(65) Prior Publication Data

US 2020/0370258 A1 Nov. 26, 2020

Related U.S. Application Data

(60) Provisional application No. 62/851,361, filed on May 22, 2019.

(51) Int. Cl.
*E01H 5/10* (2006.01)

(52) U.S. Cl.
CPC ..... *E01H 5/108* (2013.01)

(58) Field of Classification Search
CPC ..... E01H 5/10; E01H 5/108
USPC ..... 37/199, 227, 228, 229
See application file for complete search history.

(56) References Cited

U.S. PATENT DOCUMENTS 1,722,843 A * 7/1929 Fasul ..... E01H 5/106 239/130
3,447,188 A * 6/1969 Maasberg ..... E01H 1/103 15/320
4,845,801 A * 7/1989 Milly ..... E01H 1/103 15/321
5,561,921 A 10/1996 Vanderlinden
5,630,286 A 5/1997 Vanderlinden
5,797,203 A 8/1998 Vanderlinden
10,280,576 B1 * 5/2019 Osorio ..... E01H 5/102
2010/0012784 A1 1/2010 Bourgault

FOREIGN PATENT DOCUMENTS

| | | |
|---|---|---|
| CN | 2667000 | 12/2003 |
| CN | 2887952 | 5/2006 |
| CN | 201162195 | 3/2008 |
| CN | 201660869 U | 12/2010 |
| CN | 101268409 A | 8/2011 |
| CN | 102168409 A | 8/2011 |

(Continued)

OTHER PUBLICATIONS

Figure and abstract from CN 201660869 U, published Dec. 2010.*

(Continued)

*Primary Examiner* — Gary S Hartmann
(74) *Attorney, Agent, or Firm* — AVEK IP, LLC

(57) ABSTRACT

An ice elimination device for removing ice from a surface, which may be pulled or driven over a surface. The ice elimination device includes an ice elimination section that includes an applicator capable of distributing a flow of steam, hot water or both, a squeegee element capable to scrape liquid off of a surface, and one or more vacuum elements positioned to suction off liquid scraped by said squeegee. The ice elimination may include a surface drying section that includes a heater to apply heat to a portion of the surface and then utilizes a plurality of fans to generate an air flow that engages the heated portion of said surface. The combination of the heat and the fan evaporates all or most of any moisture on the surface after the squeegee and vacuum have collected and removed the melted ice, condensed steam, and/or applied hot water.

14 Claims, 5 Drawing Sheets

(56) References Cited

FOREIGN PATENT DOCUMENTS

| | | | |
|---|---|---|---|
| CN | 202466504 | | 12/2011 |
| CN | 102704431 | | 4/2012 |
| CN | 204298782 | | 12/2014 |
| CN | 105862647 | A | 8/2016 |
| CN | 205711946 | U | 11/2016 |
| JP | H 11-217810 | A | 8/1999 |
| JP | H11217810 | A | 8/1999 |
| WO | WO-2011-117660 | A2 | 3/2011 |
| WO | WO2011117660 | | 3/2011 |

OTHER PUBLICATIONS

"Preliminary Data Summary Airport Deicing Operations (Revised)," http://water.epa.gov/scitech/wastetech/guide/airport/upload/2005_10_07_guide_airport.pdf; pp. 48, 52, 53.

Abstract from "Microwave-Steam Based Road Deicing Vehicle Focused on Thin Ice Layers," http://papers.sae.org/2015-01-0502; pub'd Apr. 14, 2015.

* cited by examiner

ICE ELIMINATION DEVICE

CROSS-REFERENCE TO RELATED APPLICATION

This application claims the benefit of U.S. provisional application Ser. No. 62/851,361, filed May 22, 2019, entitled ICE ELIMINATION DEVICE.

BACKGROUND

Winter weather and the resulting ice on roadways, runways, and parking lots pose a threat to safety and equipment. One of the most dangerous conditions for any situation is when the surface is covered in ice as traction and slipping make controlling the travel of a vehicle very difficult. Many roadway accidents are the result of vehicles sliding or losing control due to ice covered roads.

Further, even if a de-icing solution is used, often times that solution is hazardous for the surrounding environment and may leach into the surrounding public water supply or recreational water supplies causing harms to humans and/or animals.

As such, there is a need in the art for a device which effectively removes frozen precipitation such as snow or ice that has formed on a surface such as a road, runway, bridges, or parking lots, while minimizing or avoiding chemicals that could harm the surrounding environment.

SUMMARY

Embodiments of the invention are defined by the claims below, not this summary. A high-level overview of various aspects of the invention is provided here to introduce a selection of concepts that are further described in the Detailed Description section below. This summary is not intended to identify key features or essential features of the claimed subject matter, nor is it intended to be used in isolation to determine the scope of the claimed subject matter.

The present invention is directed to an ice elimination device capable of removing frozen precipitation (e.g., snow or ice) from a surface. The invention may include a frame that is at least partially supported by two or more wheels, where the frame is located above the surface being treated. The ice elimination device may be driven or pulled over a surface to remove frozen precipitation, wherein the surface may be a road, a runway, a parking lot, sidewalk or other traveled surface. The ice elimination device may include an applicator adapted to deliver a heated fluid, such as steam or hot water (or both), to the frozen precipitation. The heated fluid may be created by heating a treatment liquid (such as water) using a heater. A storage tank may be used to store the treatment liquid. When the heated fluid is delivered to the frozen precipitation, it promotes melting of the frozen precipitation into a liquid (also referred to herein as unfrozen precipitation).

In addition, the invention may include a squeegee element, wherein the squeegee may be capable scraping or gathering at least a portion of the unfrozen precipitation at least during a movement of the ice elimination device in a direction of travel. One or more vacuum elements may be positioned to remove at least a portion of the unfrozen precipitation, the condensed steam or applied hot water and various solids that may be present on the surface. Once these substances are suctioned by a vacuum element, they may be filtered by one or more filters to remove any solids or other liquids or contaminants. After filtration, these substances may be sent to a collection tank, which is in fluid communication with the vacuum element. Liquid in the collection tank can be delivered to a storage tank so that the liquid can be converted to a heated fluid, thereby allowing the present device to recycle liquid to have an almost continuous supply of water as it operates. Liquid in a storage tank that may be converted to a heated fluid is also referred to herein as treatment liquid.

After the frozen precipitation is melted, the ice elimination device may dry the surface using a heater to apply heat to a portion of the surface thereby raising the temperature of the surface and then utilizes one or more air outlets to deliver air flow to the heated surface. An air outlet can take a number of forms including a fan or blower outlet. The combination of the heat and the delivered air evaporates all or most of any moisture on the surface after the squeegee and vacuum have collected and removed the frozen precipitation that has been melted and the condensed steam or applied hot water.

In one embodiment, the ice elimination device includes an applicator that distributes steam against the surface and further comprising a steam generator in fluid communication with a water tank, and the applicator being in fluid communication with said steam generator via a delivery tube.

In another embodiment, the applicator distributes hot water and the ice elimination device further comprises a water heater in fluid communication with a water tank, and the applicator being in fluid communication with said water heater via a delivery tube.

An embodiment of the present ice elimination device may also include one or more fans disposed in an angular orientation with respect to the surface being treated so as to product a circular or cyclonic air flow.

The ice elimination device may include an embodiment wherein the heaters heat the surface to a temperature between 200 and 212 degrees Fahrenheit.

The ice elimination device may also include an embodiment that comprises a vacuum generator and a collection tank, wherein said vacuum is in fluid communication with said vacuum generator and said collection tank, wherein said collection tank receives liquid removed by the vacuum.

The ice elimination device having an embodiment that further comprises a solids filter disposed relative to said collection tank so as to collect solids contained in liquid removed by the vacuum.

Other aspects and advantages of the present invention will be apparent from the following detailed description of the preferred embodiments and the accompanying drawing figures.

BRIEF DESCRIPTION OF THE DRAWINGS

The accompanying drawings form a part of the specification and are to be read in conjunction therewith, in which like reference numerals are employed to indicate like or similar parts in the various views, and wherein.

DETAILED DESCRIPTION

Figure 1:
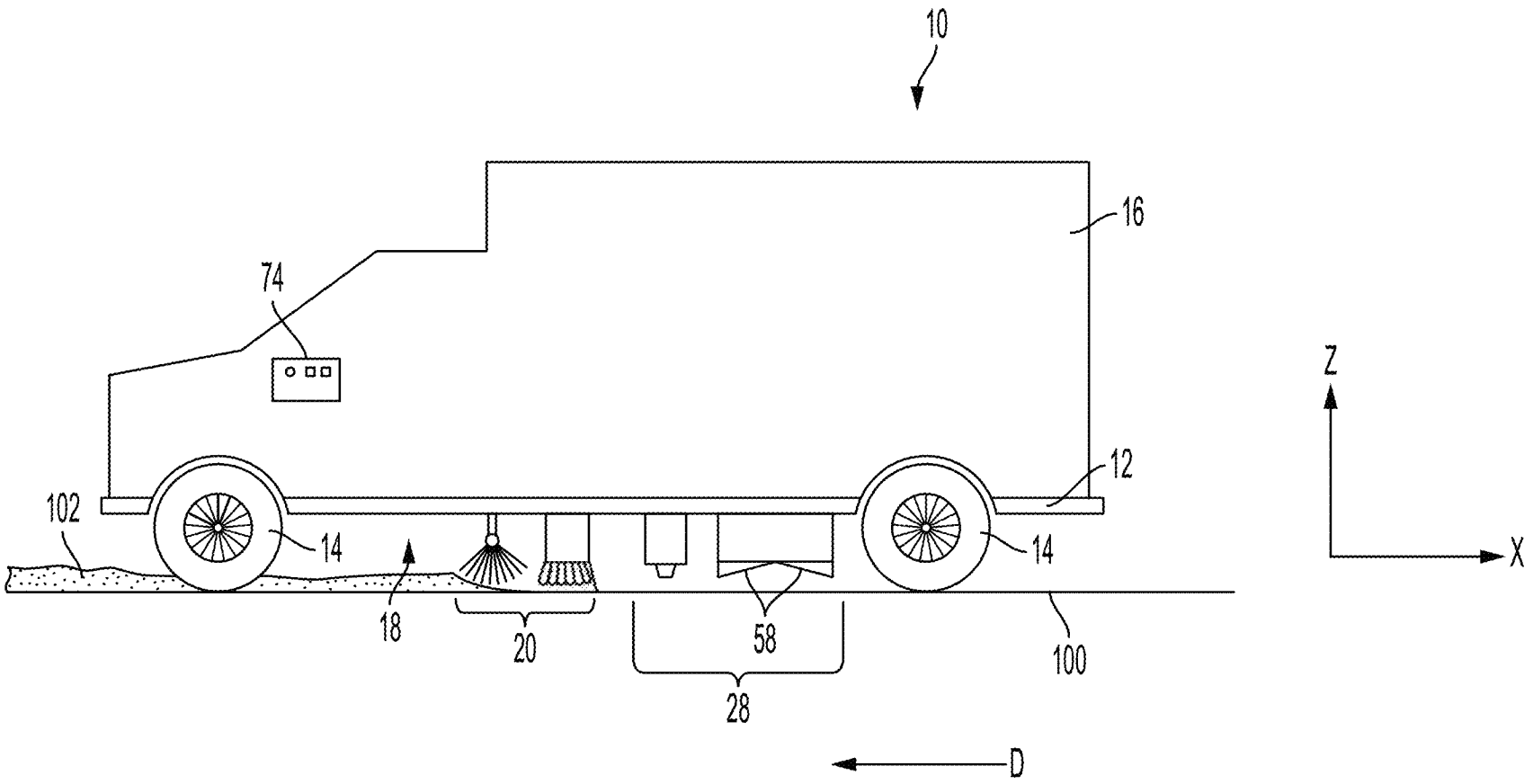
FIG. 1 is a schematic side view of one embodiment of an ice elimination device in accordance with the teachings of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

Figure 2:
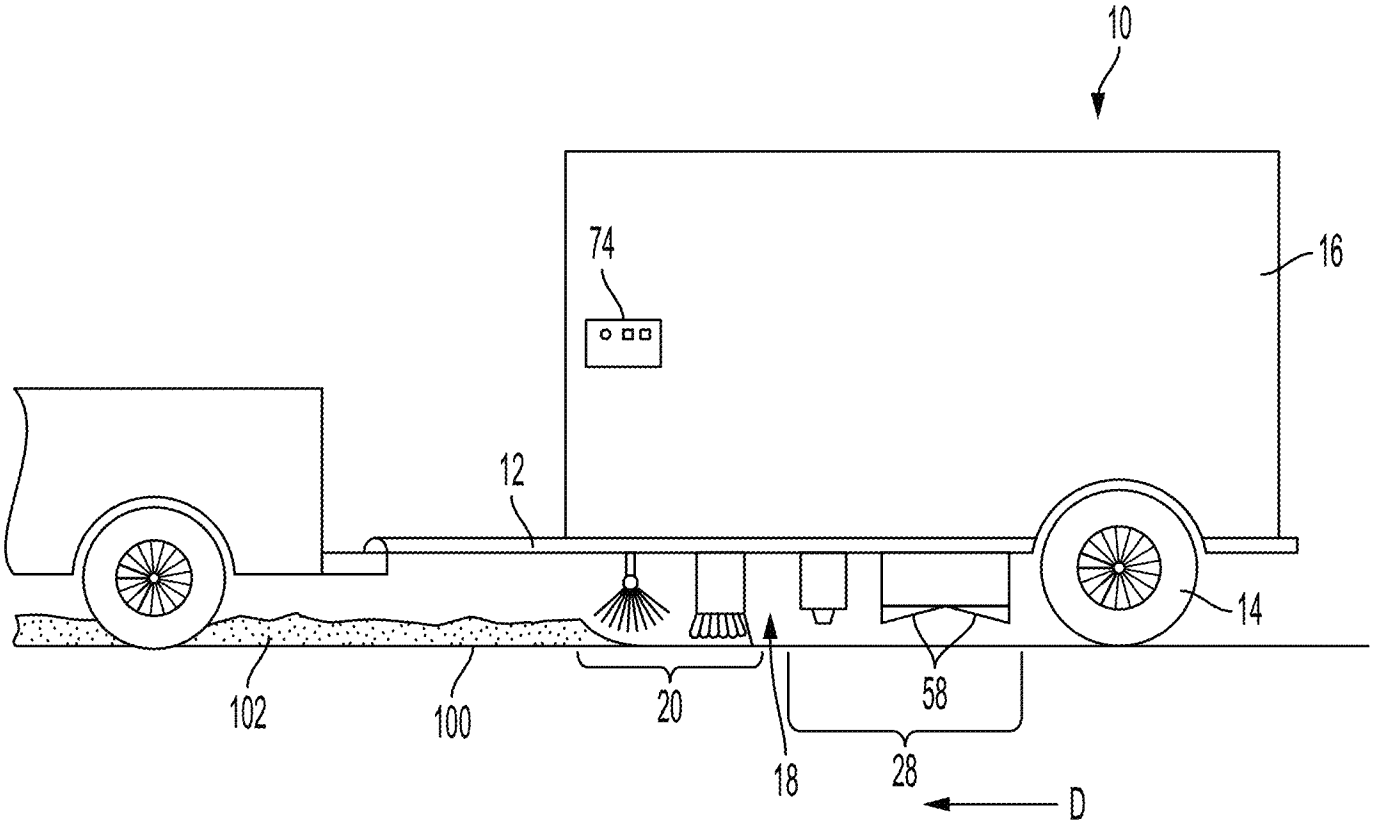
FIG. 2 is a schematic side view of another embodiment of an ice elimination device in accordance with the teachings of the present invention.

As shown in FIG. 1, the present invention is directed toward an ice elimination device 10 that comprises generally a chassis or frame 12 that rests on a plurality of wheels 14, wherein the ice elimination device may be truck having a cab, an engine, and steering wheel supported on at least two axles and four wheels, or, alternatively, as shown in FIG. 2, a trailer may be the ice elimination device wherein the frame 12 is partially supported on one axle with at least two wheels, and in another embodiment, a double-axle trailer supported by at least 4 wheels. In any case, the ice elimination device 10 includes a body 16 that surrounds in internal components and an underside 18 at which an ice elimination section 20 and a drying section 28 are disposed.

Ice elimination section 20 generally comprises an applicator 22 adapted to deliver a heated fluid (such as steam or hot water) and a vacuum 26 with a squeegee member 24. The steam/water applicator 22 discharges a stream of steam or hot water onto frozen precipitation 102 (such as snow or ice) that has accumulated on surface 100. The squeegee member 24 scrapes against the surface 100 being de-iced to catch liquid on the surface 100 and vacuum elements 26 removes the liquid from the surface 100. As further shown, drying section 28 generally comprises one or more heaters 30 that deliver heat to raise the temperature of the surface 100 and an air delivery element 32 that blows air against the surface.

Figure 3:
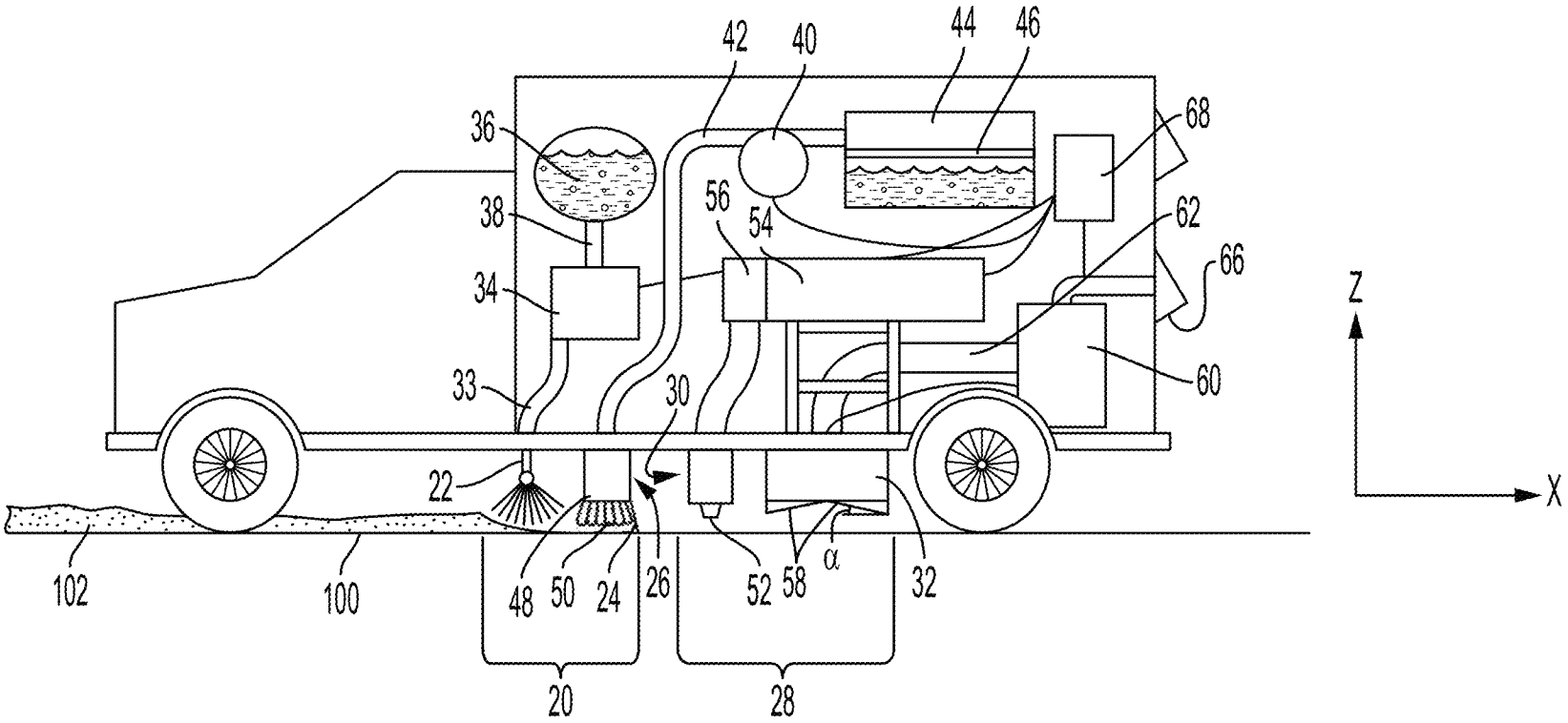
FIG. 3 is a schematic side view of one embodiment of an ice elimination device in accordance with the teachings of the present invention showing the internal components thereof.

As shown in FIG. 3, steam/water applicator 22 is in fluid communication with a heating component 34 through one or more delivery hoses or tubes 33, and wherein heating component 34 is in fluid communication and may receive water from water storage tank 36 through water delivery hose or tube 38. Heating component 34 may take the form of a steam generator or water heater. A water heater heats water, but the water remains in a liquid phase instead of the gaseous phase of steam. For the purposes of this disclosure hot water shall be deemed any water that has a temperature between 100-212 degrees Fahrenheit, preferably between 200-212 degrees Fahrenheit.

Vacuum 26 may comprise a vacuum generator 40 which creates a suction force to vacuum heads 48 to suck up the frozen precipitation 102 that has been melted to liquid form (e.g., water) and roadway debris through hoses or tubing 42. Hoses or tubing 42 then carries the melted precipitation (water) and debris to a waste collection tank 44. In one embodiment, a filter 46 may be utilized to remove any solids, liquids, chemicals, or other contaminants from the vacuumed fluid before the fluid is sent to collection tank 44. Vacuum heads 48 may have a skirt 50 disposed so as to ensure the vacuum suction is focused on the area directly below the vacuum heads and minimize the capture of air outside the focus area.

In one embodiment, heating component 34 or water storage tank 36 may also be in fluid communication with collection tank 44 so that water collected through the de-icing process can be re-used as steam or hot water are applied to melt the frozen precipitation 102. The recovered water can be sent from collection tank 44 to water storage tank 36 using a pump or a gravity feed system. This provides the present device an almost continuous supply of water as it operates. In operation, the device wherein the water storage tank 36 receives recovered water from the collection tank 44 consumes less water and substantially continuous, if not certainly longer operating runs.

One embodiment includes a heater 30 including a plurality of heat nozzles 52 wherein heat nozzles 52 are in fluid communication with a furnace 54 that generates heat and a blower 56 that blows the heated air out of the nozzles 52 onto the surface 100. In one embodiment a plurality of furnaces 54 and blowers 56 are used.

Figure 4:
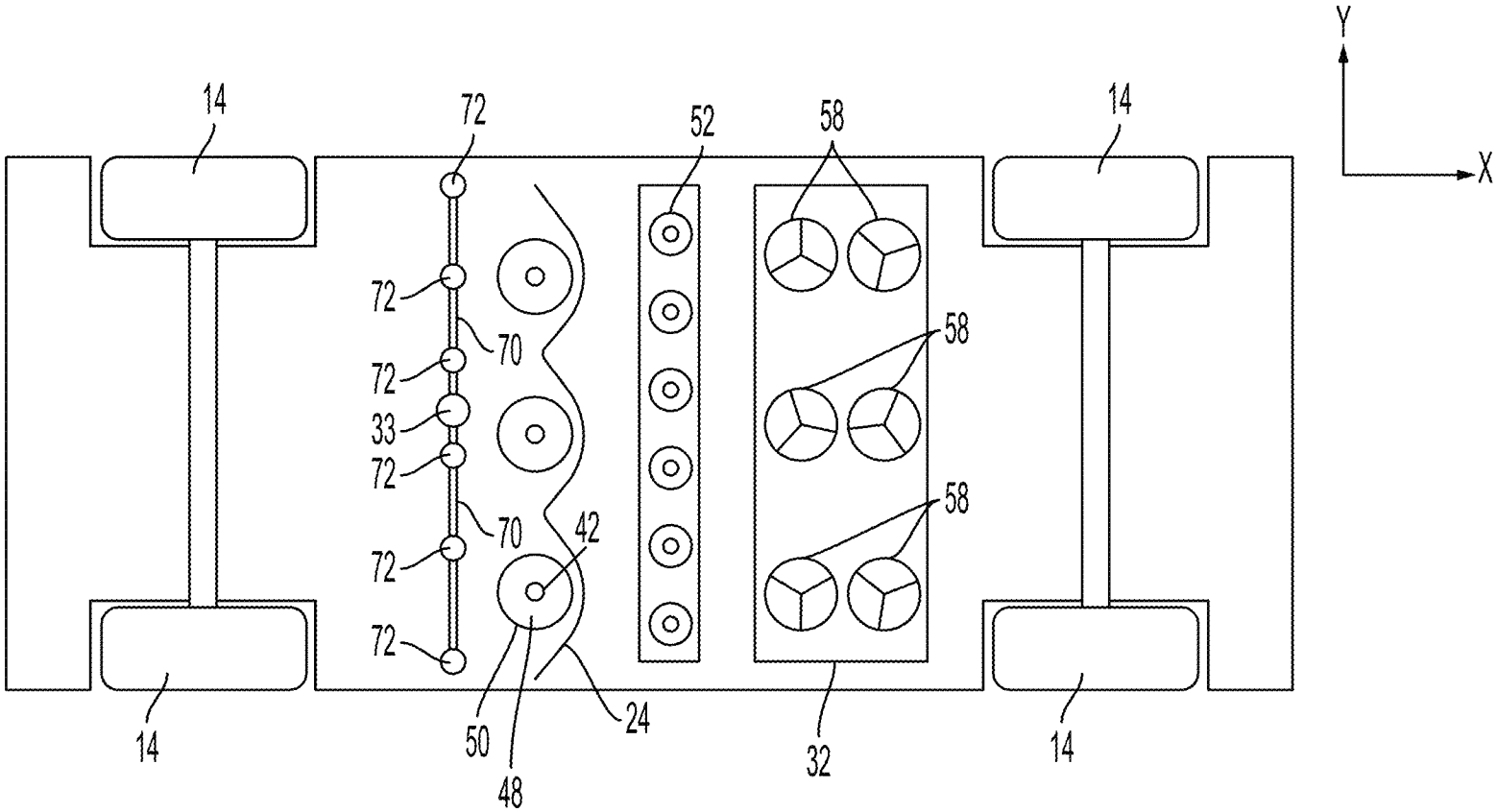
FIG. 4 a schematic bottom view of one embodiment of an ice elimination device in accordance with the teachings of the present invention.
Figure 5:
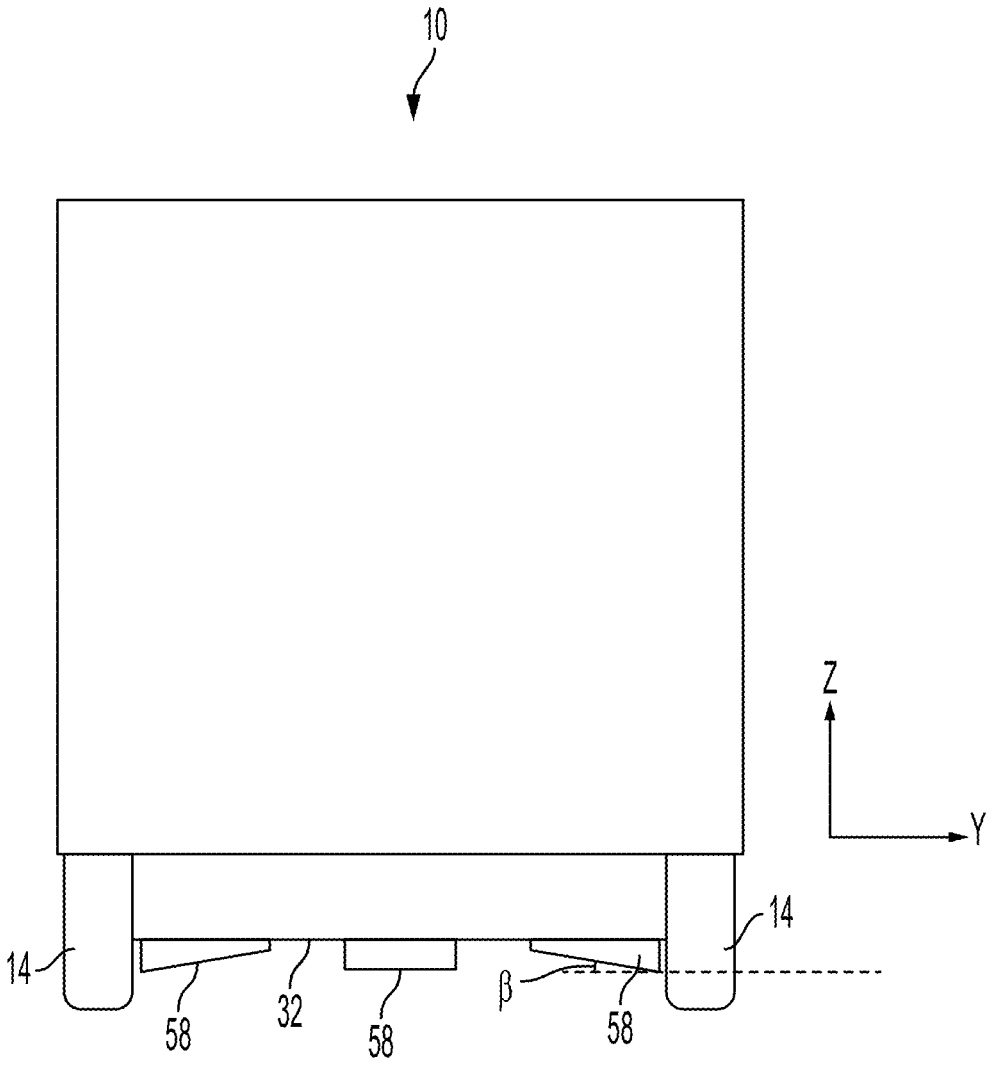
FIG. 5 is a schematic rear view of one embodiment of an ice elimination device in accordance with the teachings of the present invention.

As shown in FIG. 4, in one embodiment of the present invention, air delivery element 32 comprises a plurality of individual air outlets 58. Each air outlet 58 may take the form of a fan, blower outlet, or other air delivery mechanism. If fans are used for air outlets 58, the fans may include individually driven propellers within each fan. If air outlets 58 deliver air from one or more blowers 60, each blower 60 may be in fluid communication with the air outlets 58 through a plurality of ducts 62. Each blower 60 may be in fluid communication with an air intake vent 66 that is in fluid communication with an air source, such as the atmosphere. In one embodiment, air outlets 58 may be configured, shaped, or positioned so that each fan or blower outlet is disposed to direct the air flow traveling there-through at an angle $\alpha$ relative to the axis X as shown in FIG. 3 and/or at an angle $\beta$ relative to the axis Y as shown in FIG. 5, to create a cyclonic or anti-cyclonic like air flow to extend the amount of time the air flows over the surface 100. In one embodiment, angle $\alpha$ may range from zero to forty-five (0-45) degrees and angle $\beta$ may similarly vary from zero to forty-five (0-45) degrees. The cyclonic or anti-cyclonic air flow means air flow in a circular pattern to maximize the air-to-surface contact of the moving air within the area directly beneath the air outlet 58.

The air flow generated by the angular orientations of the air outlet 58 is configured to maximize the time the moving air engages the surface below the present ice elimination device 10. The combination of the heat delivered by heat nozzles 52 and the circular/cyclonic air flow generated by air outlets 58 promotes the evaporation of any water or liquid remaining on the surface 100 after the ice elimination section 20 passes over the surface 100.

FIG. 4 further illustrates a bottom view of the ice elimination device 10 in an embodiment of the present invention wherein the steam/water applicator 22 further comprises a distribution system comprising one or more manifolds 70 in fluid communication with a delivery tube 33 wherein a plurality of nozzles 72 are disposed along a manifold 70. Each nozzle 72 may have pre-determined spray pattern so as to ensure a continuous spray of steam or hot water over the entire width of the ice elimination device 10 or the street lane. FIG. 4 shows an embodiment wherein squeegee member 24 has an undulating shape so as to direct liquid remains of the vacuum heads 48 to be sucked into tube 42. In this embodiment, a lesser number of vacuums may be used. However, another embodiment is envisioned wherein the squeegee member 24 is straight across, and/or includes one or more point of concentration. In yet another embodiment, squeegee 24 may be the other side of the vacuum heads 48 and are arranged to channel the melted snow or ice, hot water, and/or condensed steam into the vacuum heads 48 to be removed from the surface 100. It is foreseen that squeegee member 24 can take a number of forms and be fabricated from various materials. The material and form of squeegee member 24 will depend on the application. For example, squeegee member 24 could be a fabricated from rubber, plastic, metal or a composite material, and it could be solid, perforated, slotted, or it may have a series of bristles.

FIG. 3 shows a generator 68 that may be utilized to provide mobile electric power to the ice elimination device 10. In one embodiment where air outlets 58 take the form of fans, generator 68 may supply electrical power to the fans and the fans may be turned on all together or individually.

FIGS. 1 and 2 show a control system 74 that may be electronically connected to each element of the present ice elimination device 10, wherein the control system 74 is capable of controlling the operational parameters of each element, including turning the each element on or off, adjusting the spray volume of the steam/water applicator 22, the temperature of the steam/water, the operation of the vacuum 26, the temperature and air blowing velocity of the heater 30, and the operation of the fans and/or blowers 58.

In use, ice elimination device 10 may be driven (a truck) or pulled (a trailer) over a section of a surface 100, such as a roadway, a bridge, an airport runway, a parking lot or any other surface that is covered in frozen precipitation 102 such as snow or ice. As the ice elimination device 10 travels of surface 100 covered in the frozen precipitation 102, steam or hot water is sprayed from a steam/water applicator 22 onto the frozen precipitation 102. The elevated temperature of the steam/hot water melts through the frozen precipitation 102 and creates a liquid or unfrozen precipitation. Next a squeegee section 24 may be disposed to scrape across surface 100 so as to catch or accumulate the liquid and pull it along. A vacuum 26 includes one or more vacuum heads 48 disposed either in front or behind the squeegee in the direction of travel D and the liquid caught by the squeegee is sucked up through a vacuum head 48, through tube 42 and then deposited into collection tank 44. Collection tank 44 may have a filter 46 disposed to catch any debris, sand, gravel, or other solids that are removed from surface 100 with the liquid. Filter 46 may be disposed for easy removal so that the solids can be removed at will by an operator. The steam/water applicator 22, squeegee 24, and vacuum 26 comprise the ice elimination section 20 of the device, which is responsible for melting the frozen precipitation 102 from the surface 100.

Next, the drying section 28 of the present ice elimination device will pass over a section of the surface 100. The drying section 28 will heat the surface 100 using heaters 30 and apply a flow of air using air outlets 58 in order to quickly dry surface 100 so ice does not re-form from the steam or hot water applied and melting resulting therefrom. As shown in FIGS. 3 and 4, heater 30 includes plurality of heat nozzles 52 wherein heat nozzles 52 are in fluid communication with a furnace 54 that generates heat and a blower 56 that blows the heated air out of the nozzles 52 onto the surface 100. In one embodiment, a plurality of furnaces 54 and blowers 56 are used to generate a flow of heated air that is directed against surface 100 by nozzles 52. The heaters deliver air heated to a temperature between 150 and 300 degrees Fahrenheit. A preferred temperature is around 200 degrees Fahrenheit. As the surface 100 is being heated, air outlets 58, which could take the form of fans or blower outlets, direct a flow of air over the heated surface to further promote the evaporation of water or other liquid from surface 100.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. An ice elimination device capable of removing frozen precipitation from a surface that is being treated, said ice elimination device comprising:

a frame at least partially supported by two or more wheels, said frame located above the surface being treated, said frame having a front end and a back end;

an applicator adapted to deliver a heated fluid to the frozen precipitation thereby melting the frozen precipitation into a liquid;

a vacuum adapted to remove at least a portion of said liquid;

a heater adapted to raise the temperature of the surface being treated after said removed portion of liquid has been removed, said heater including at least one nozzle adapted to deliver heat to the surface being treated; and an air outlet from which an air flow is delivered onto the surface being treated, said air outlet located rearward of said nozzle with respect to the front end of said frame.

2. The ice elimination device of claim 1 wherein said heated fluid is steam.

3. The ice elimination device of claim 1 wherein said heated fluid is water having a temperature between 100 and 212 degrees Fahrenheit.

4. The ice elimination device of claim 1 wherein said air outlet comprises a fan.

5. The ice elimination device of claim 4 wherein a face of said fan is disposed in an angular orientation with respect to the surface being treated.

6. The ice elimination device of claim 1 wherein said heater is adapted to deliver air heated to a temperature between 150 and 300 degrees Fahrenheit.

7. The ice elimination device of claim 1 further comprising a collection tank, wherein said vacuum is in fluid communication with said collection tank, wherein said collection tank is adapted to receive said removed portion of liquid.

8. The ice elimination device of claim 7 further comprising a filter to remove contaminants from said liquid removed by said vacuum prior to said liquid being received in said collection tank.

9. The ice elimination device of claim 8, wherein said collection tank is adapted to supply liquid for use as said heated fluid delivered from said applicator.

10. An ice elimination device capable of removing frozen precipitation from a surface being treated, said ice elimination device comprising:

a frame at least partially supported by two or more wheels, said frame located above the surface being treated, said frame having a front end and a back end;

a storage tank for storing a treatment liquid;

a heater adapted to heat said treatment liquid to create a heated fluid;

an applicator adapted to deliver said heated fluid to the frozen precipitation thereby melting the frozen precipitation into unfrozen precipitation;

a squeegee member for accumulating said unfrozen precipitation;

a vacuum adapted to remove at least a portion of said unfrozen precipitation;

a collection tank to receive said removed portion of unfrozen precipitation;

a nozzle adapted to deliver heat to the surface being treated; and an air outlet from which an air flow is delivered onto the surface being treated, said air outlet located rearward of said nozzle with respect to the front end of said frame.

11. The ice elimination device of claim 10 wherein a face of said air outlet is disposed in an angular orientation with respect to the surface being treated.

12. The ice elimination device of claim 11 further comprising a filter to remove contaminants from said removed portion of unfrozen precipitation prior to being received in said collection tank.

13. The ice elimination device of claim 12 wherein said heated fluid is steam.

14. The ice elimination device of claim 12 wherein said heated fluid is water having a temperature between 100 and 212 degrees Fahrenheit.

* * * * *